United States Patent [19]

Horiba et al.

[11] 4,302,659

[45] Nov. 24, 1981

[54] CERAMIC HEATER-ELEMENT TO BE USED FOR CIGARETTE-LIGHTERS

[75] Inventors: Tamotsu Horiba, Gifu; Shigeyuki Hikita, Nagoya, both of Japan

[73] Assignee: Kabushiki Kaisha Tokai Rika Denki Seisakusho, Aichi, Japan

[21] Appl. No.: 122,075

[22] Filed: Feb. 15, 1980

[30] Foreign Application Priority Data

Feb. 15, 1979 [JP] Japan ..... 54-16836

[51] Int. Cl.[3] ..... F23Q 7/22

[52] U.S. Cl. ..... 219/270; 13/25; 219/552; 219/541; 361/264; 338/326; 338/330

[58] Field of Search ..... 13/20, 25; 219/267, 219/270, 541, 552, 553, 538, 523; 361/264, 266; 338/330, 297, 323, 326, 328

[56] References Cited

U.S. PATENT DOCUMENTS

| | | | |
|---|---|---|---|
| 3,409,728 | 11/1968 | Jaques | 13/25 |
| 3,467,812 | 9/1969 | Terrell | 261/266 X |
| 3,681,737 | 8/1972 | Magnusson et al. | 338/330 X |
| 3,709,998 | 1/1973 | Anthony et al. | 13/25 |
| 3,800,057 | 3/1974 | Kuhlmann-Schafer et al. | 13/25 |
| 3,842,319 | 10/1974 | Perl | 361/264 X |
| 3,875,477 | 4/1975 | Fredriksson et al. | 361/264 |
| 4,058,701 | 11/1977 | Gruber et al. | 219/270 |

*Primary Examiner*—Volodymyr Y. Mayewsky
*Attorney, Agent, or Firm*—Wenderoth, Lind & Ponack

[57] ABSTRACT

A ceramic heater-element to be incorporated into a plug to be pressed into a socket provided on a front inner car-body, thereby providing a cigarette-lighter, which comprises an annular shaped heater-portion having a radially extending gap thereby providing two opposing end-portions, and a pair of electrode-portions, each being extended substantially downwardly from each of the two end-portions while being in a parallel relationship with a center axis of the heater-portion, wherein respective cross-sectional dimensions through which the electric current flows are so arranged that the cross-sectional area of the heater-portion is relatively smaller than either of the cross-sectional areas of the electrode-portions.

2 Claims, 9 Drawing Figures

CERAMIC HEATER-ELEMENT TO BE USED FOR CIGARETTE-LIGHTERS

BACKGROUND OF THE INVENTION

This invention relates to a cigarette-lighter, and more particularly, to an electrical heater-element of ceramics, which is incorporated into a plug which is inserted into a socket provided on a front inner car-body, thereby providing the cigarette-lighter.

Conventionally, the plugs making up the cigarette-lighters with sockets provided in cars have been comprised by electrical heater-elements of metallic material.

According to a recent trend, in place of the electrical heater-elements of metallic material, several ceramic materials of the electrical conductive type have been attempted to be employed as the material for constituting the electrical heater-elements due to their heat-resistant characteristics and their oxidization-resistant characteristics. However, the attempts described above for introducing the ceramic materials of the above-described type have not been brought into practical application as yet owing to various problems involved.

For example, there has been already proposed such a plug wherein an outer circumference of a disc-like heater-element of ceramic material, being accommodated inside a heater-casing, is electrically connected to the heater-casing, while a main portion of the heater-element is connected to a metallic electrode coupled to an electric source. However, such a plug of a type as described above has a substantial defect in that since the ceramic materials of the above-described type can be heated up to such a high temperature of 1700° C., the metallic electrode, especially its portion joined with or connected to the heater-element becomes quickly overheated and then is brought into a non conductive state through a continuous energization. In addition, as is well known, since the molding powders of ceramic material are generally difficult to be homogeneously composed, respective compositions of the products are often nonuniform. Therefore, according to such a ceramic heater-element as described above, since the path of the electric current is not specifically defined, the electric current tends to flow for the portions relatively homogeneously composed, thus resulting in the substantial overheat in and around non-homogeneous local portions of the heater-element. Due to the local overheat of the above-described type, the local coefficient of thermal expansion may differ among several portions of the heater-element, whereby cracks or crevices are resultantly caused to be formed. More specifically, a heater having as main portion of a relatively small cross-section is first rendered extraordinarily high in temperature resulting in either the degradation of the material constituting the main portion or cracks in and around the main portion, accordingly.

SUMMARY OF THE INVENTION

Accordingly, an essential object of the present invention is to provide a ceramic heater-element to be incorporated into a plug to be pressed or inserted into a socket provided on a front inner car-body, thereby providing a cigarette-lighter, which is arranged to overcome all the disadvantages included in the prior art specifically described in the foregoing.

Another important object of the present invention is to provide a ceramic heater-element of the above-described type, which is compact in size and highly efficient in use.

A further object of the present invention is to provide a ceramic heater-element of the above-described type, which can be manufactured at lost cost.

In accomplishing these and other objects according to one preferred embodiment of the present invention, there is provided a ceramic heater-element as will be described hereinbelow. The heater-element of ceramic material, such as SiC, (La, Sr) (Co, Cr)$O_3$ or the like, which comprises a heater portion arranged in the form of an incomplete ring or annular shaped portion with a radially extending gap having paired end-portions thereby providing a sliced cut off portion between the both end-portions and a pair of electrode-portions, each being extended substantially downwardly from each of the paired end-portions while being in a parallel relationship with a center axis of the heater portion. A central through bore for the heater portion is so arranged so that its periphery is much smaller than a periphery of the cross-section of the cigarettes of the ordinary type. Although the heater portion and the paired electrode-portions are integrally molded, respective cross-sectional dimensions through which the electric current flows are so arranged that the ratio of the cross-sectional area of the heater-portion to that of each of the electrode-portions is either one to two or one to three.

By the arrangement as described in the foregoing, the current density specific to the heater portion becomes much higher than that specific to either of the electrode-portions, whereby with respect to heat flux or the rate of heat generation for the unit area, the ratio of the latter to the former becomes either one to two or one to three approximately. Accordingly, both the degradation of the paste spread on the respective electrodes and the undesirable heat-effects upon the metallic electrodes each incorporated into a portion of each electrode-portion are avoided, thus resulting in that an undesirable non-conductive state, which is often otherwise brought about through a poor connection of the metallic electrode to the electrode portion, is avoided. In addition, since the current path of the heater-portion is arranged to have a comparatively small cross-section and to be comparatively long, the current of electricity is restricted in a moderate manner, whereby the locally extraordinary generation of heat on the heater-portion as well as an undesirable occurrence of cracks or crevices in and around the heater-portion are both avoided.

According to the present invention, a plug, into which the present heater-element is incorporated, comprises the ceramic heater-element of the above-described type; a heater-casing of electric conductive material, a bottom of which is partially cut off, so that the paired electrodes can extend downwardly therethrough; an electrical insulating board interposed between the heater-portion and the bottom of the heater-casing; an electrical insulating member provided with a rivet of electric conductive material; a first enclosing member of electrical conductive material for supporting one of the electrode-portions with a first screw of electrical conductive material, said first enclosing member being secured to a rear side of the bottom of the heater-casing at its top boundary, while a lower portion is secured to the electrical insulating member and a second enclosing member of electrical conductive material for supporting the other of the electrode-portions with a second screw of electrical conductive material, a lower portion of said second enclosing member is secured to the electrical insulating member while a partial portion of the lower portion extends through the electrical insulating member and then folded inwardly thereby permitting it to be secured to the rear face of the electrical insulating member with the rivet.

By the plug having the arrangement as described in the foregoing, when the plug is inserted into a socket provided on a front inner car-body thereby causing the heater-casing to be in electrical contact with electrode members provided for the socket and connected to the electric source, such as contacts of the bimetal type, the current path is constituted as follows. The current path is a series circuit composed of the heater casing, the first enclosing member together with the first screw, one of the electrode-portions of the ceramic heater-element, the heater-portion, the other of the electrode-portions of the ceramic heater-element, the second enclosing member together with the second screw and the rivet appropriately connected to one of electrodes of the electric source in a known manner, whereby the ceramic heater-element is to generate the heat.

Accordingly, since the paired electrodes of the ceramic heater-element are arranged to extend substantially downwardly from the rear face of the heater-portion while each being in a parallel relationship as described earlier, the plug can be assembled by a simple procedure and is a compact body of the approximately cylindrical type.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1:
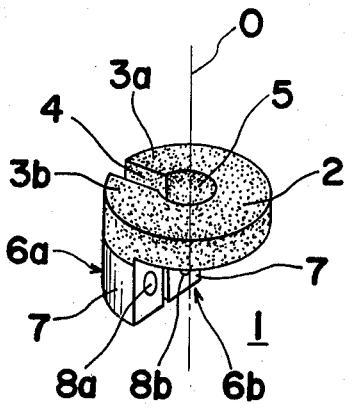
FIG. 1 is a schematic, perspective view of a ceramic heater-element to be used for cigarette lighters according to the present invention.
Figure 2:
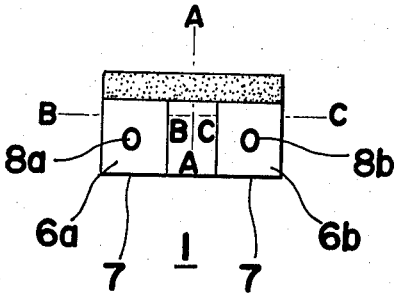
FIG. 2 is a schematic, side elevational view of the ceramic heater element shown in FIG. 1.
Figure 3:
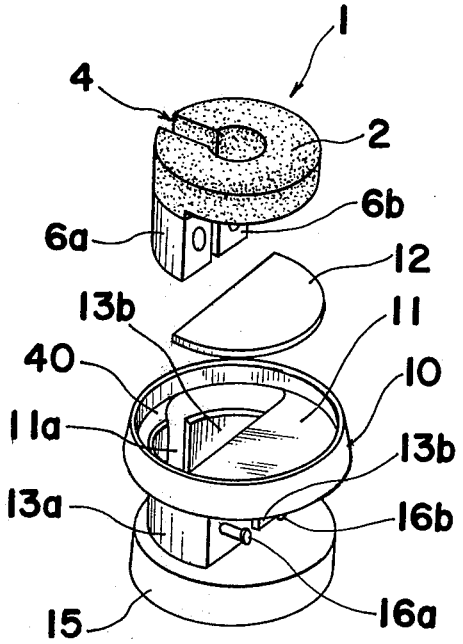
FIG. 3 is a schematic, perspective view of a plug according to the present invention, but particularly showing a disassembled feature of the plug.
Figure 4:
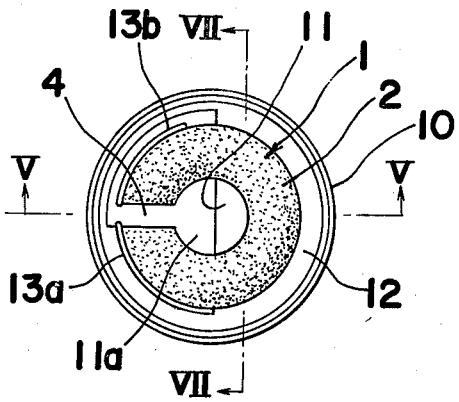
FIG. 4 is a top plain view of FIG. 3.
Figure 5:
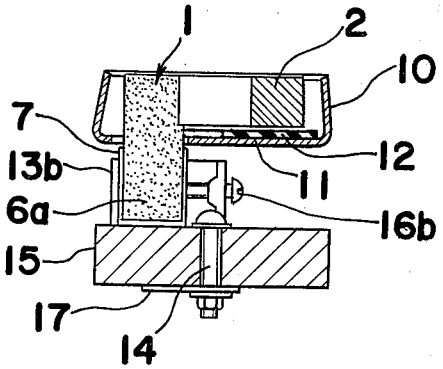
FIG. 5 is a sectional view taken along the line V—V of FIG. 4.
Figure 6:
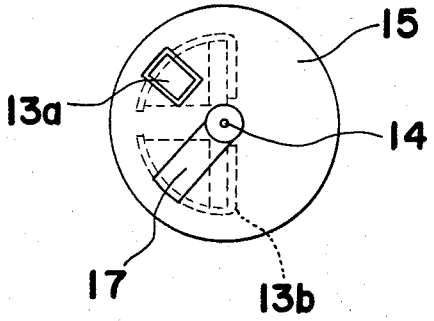
FIG. 6 is a rear plain view of FIG. 3.
Figure 7:
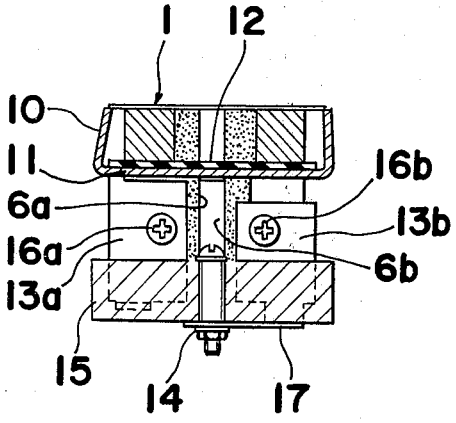
FIG. 7 is a sectional view taken along the line VII—VII of FIG. 4.

Referring now to FIGS. 1 and 2, there is shown one preferred embodiment of an electrical heater-element made of ceramic material according to the present invention, which is incorporated into a plug portion capable of being pressed or inserted into a socket provided on a front inner car-body, thereby providing the cigarette-lighter. The ceramic heater element 1 is integrally molded as one unit with anyone of the electric conductive materials such as SiC, (La, Sr) (Co Cr)$O_3$ and the like. The ceramic heater element 1 comprises an annular shaped heater portion 2, arranged to be formed into a ring of generally rectangular cross-section and having a central bore 5 and a radially extending small clearance or gap 4 radially formed between the cross-sectional end portions of the semi-annular portion 2 thereby forming opposed ends or cross-sectional end portions 3*a* and 3*b* thereat, and a pair of electrode portions 6*a* and 6*b*, each having a sector-shaped cross-section and extended substantially downwardly longitudinally outward from said heater portion 2 in a parallel relationship with an axis 0 of the heater-portion 2.

As is shown in FIG. 2, the cross-sectional configuration of the heater portion 2, taken along the plane of the radial edges of the end portions 6*a* and 6*b*, is in the form of a square or rectangle. Furthermore, a central through bore 5 formed in the ring portion 2 is so arranged that its diameter is sufficiently small when compared with the diameter of a cigarette of the ordinary type. The electrode-portions 6*a* and 6*b* are respectively treated or covered with a silver paste 7 on their outer circumferences and are respectively provided with respective recessed portions 8*a* and 8*b* so as to permit metallic electrodes to be incorporated therein.

As described previously, although the heater-portion 2 and the paired electrode-portions 6*a* and 6*b* are integrally molded, the respective cross-sectional area through which the electric current flows is so arranged that the ratio of the cross-sectional area of the heater-element 2 to that of the electrode portion 6*a* or 6*b* is either one to two or one to three. More specifically, referring now to FIG. 2, the cross-sectional rectangular or diametrical area of the heater-portion 2, which is cut cross-wise along by a line A—A, is much smaller than either of the fan-shaped cross-sectional areas or the electrode-portions 6*a* and 6*b*, which are respectively cut cross-wise along respective lines B—B and C—C. By the cross-sectional arrangement as described above, the current density specific to the heater-portion 2 becomes much higher than the current density of the electrode-portion 6*a* or 6*b*. Accordingly, the electrical resistance specific to the heater-portion 2 becomes relatively higher than either of the electrical resistances specific to the electrode-portions 6*a* and 6*b*, whereby with respect to the rate of generation of heat, the ratio of the latter to the former becomes either one to two or one to three approximately. As a result, neither the degradation of the paste spread on the respective electrodes 6*a* and 6*b*, nor the undesirable heat-effects upon the metallic electrodes (not shown here) each incorporated into each recessed portion as previously described are effected, thus resulting in that an undesirable non-conductive state which is often otherwise brought about through a bad connection of the metallic electrode to the electrode-portion, is avoided. In addition to the above-described advantages, current paths of both portions are relatively long in spite of their comparatively small-scaled configurations. More specifically, since the current path of the heater portion 2 is arranged to have a comparatively small cross-section and to be comparatively long, the flow of electric current is restricted in a moderate manner, whereby the locally extraordinary generation of heat on the heater-portion 2 as well as the undesirable occurrence of the cracks or crevices in and around the heater-portion 2 are both avoided.

Referring now to FIG. 3 to FIG. 7, there is shown one preferred embodiment of a plug according to the present invention, with the ceramic heater-element 1 being accommodated therein.

Besides the ceramic heater-element, the plug comprises a heater-casing 10 whose bottom plate is approximately semicircular, insulating board 12 which is interposed between the heater-portion 2 and the bottom 11 of the casing 10, an approximately C-shaped supporting member 13*a* of electrical conductive material for enclosing the electrode-portion 6*a*, thereby to support the portion 6*a*, another approximately C-shaped member 13*b* of the electrical conductive material for enclosing the electrode-portion 6*b* therewith, thereby to support the portion 6*b*, and an insulator 15 having a terminal screw, a rivet 14 or the like at the center.

The plug described above is assembled in the unit in a manner as follows. As far as the ceramic heater-element 1 is concerned, the heater-portion 2 is first accommodated inside the heater-casing 10 in a manner such that the paired electrode-portions 6*a* and 6*b* are substantially downwardly projected from an aperture 11*a* made by cutting off the bottom 11 as described above, with the heater-portion 2 being positioned on the bottom 11. As previously described, the electrical insulating board 12 is interposed between the bottom 11 and the heater-portion 2 thereby electrically insulating the heater portion 2 from the heater-casing when the ceramic heater-element is in position as described above. Furthermore, the circumference of the heater portion is spaced apart from an inner circumference of the heater-casing 10, so that these are not in contact with respect to each other. The approximate C-shaped member 13*a* is secured to a rear side of circularly shaped strip-portion 40 of the bottom 11 at its top boundary portion. The substantially lower portion of the approximate C-shaped member 13*a* is embedded in the insulator 15, while a portion of the lower portion described above is through the inside of the insulator 15 and then folded inwardly thereby to permit it to be secured to the rear face of the insulator 15 (see FIG. 6). By the arrangement as described above, the heater casing 10 itself is resultantly secured to the insulator 15 with the C-shaped member 13*a*. On the circumferential face of the approximate C-shaped member 13*a*, there is provided a screwed through bore, the location of which is arranged to coincide with that of the recessed portion 8*a* provided for the electrode portion 6*a*, when the plug is assembled in the unit. The leading end of a screw 16*a* is first fitted to the recessed portion 8*a* through the threaded bore and then, is forcibly screwed into the inside of the recessed portion 8*a* of the electrode-portion 6*a*, whereby the electrode-portion 6*a* together with the heater-portion 1 are both fixedly supported by the approximate C-shaped supporting member 13*a*.

On the other hand, as previously described, there is also provided another approximately C-shaped supporting member 13*b* of the metallic electrode, which is also arranged to be fixedly mounted on the insulator 15. Similar to the arrangement concerning the approximately C-shaped supporting member 13*a*, there is provided a threaded bore on the above-described member 13*b*, through which the leading end of a screw 16*b* is first fitted to the recessed portion 8*b* of the electrode-portion 6*b* and, then is forcibly screwed into the inside of the recessed portion 8*b* of the electrode-portion 6*b*, whereby the electrode-portion 6*b* together with the heater-portion 2 are both fixedly supported by means of the approximate C-shaped supporting member 13*b*. However, as far as the approximately C-shaped supporting member 13*b* is concerned, the top portion is not jointed with the heater-casing 10, thereby ensuring that it is not electrically connected with the heater-casing 10 (see FIG. 3), while the lower portion of the approximately C-shaped supporting member 13*b* is also embedded in or inserted into the inside of the insulator 15. However, a partial portion of the lower portion of the above-described member 13*b* is situated through the inside of the insulator 15 and then folded inwardly along the rear side-face of the insulator 15. The partial portion 17 folded inwardly is secured to the insulator 15 with the terminal screw 14 (see FIG. 6). Alternatively, in addition to the connecting arrangement as described above, each of the electrode-portions and its corresponding supporting member is jointed with each other by brazing the outer circumference of the electrode-portion and the inner circumference of the supporting member.

By the plug having the arrangement as described in the foregoing, when the plug is put into a socket provided on a front inner car-body thereby providing contact between the heater-casing and the electrode-members provided for the socket and connected to the electric source. The contacts may be of the bimetal type, and the current path is constituted as follows. The current path is a series circuit to be composed of the heater casing 10, the supporting member 13*a* together with the electrode 16*a* of the screw type, the electrode-portion 6*a* of the ceramic heater-element 1, the heater-portion 2 of the ceramic heater element 1, the electrode-portion 6*b* of the ceramic heater-element 1, the supporting member 13*b* together with the electrode 16*b* of the screw type and the terminal screw 14 appropriately further arranged to form a series circuit with all the above-mentioned constituents in a known manner, whereby the ceramic heater element 1 is to generate the heat.

According to the present invention of the plug, since the paired electrodes 6*a* and 6*b* of the ceramic heater element 1 are arranged to extend substantially downwardly from the rear face of the heater-portion 2 while each being in a parallel relationship with the axis 0 of the heater-portion 2 as described earlier, the plug can be assembled in quite a simple procedure and has a substantially compact body of an approximately cylindrical type.

Figure 8:
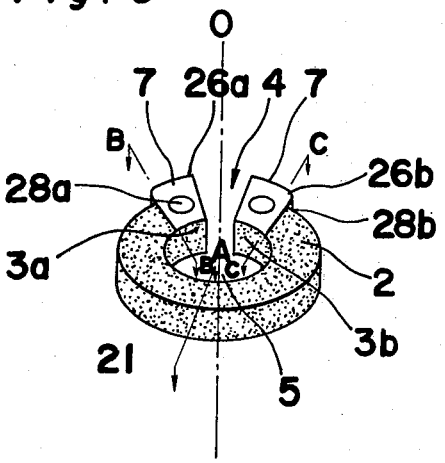
FIG. 8 is a schematic, perspective view of one modified embodiment of FIG. 1.
Figure 9:
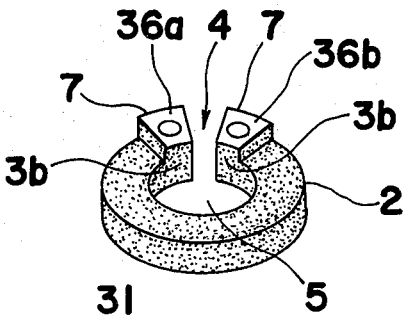
FIG. 9 is a schematic, perspective view of another modified embodiment of FIG. 1.

Referring now to FIGS. 8 and 9, there are shown modified embodiments of the ceramic heater-element 1 according to the present invention.

The ceramic heater element 21 shown in FIG. 8 is different from the embodiment shown in FIGS. 1 and 2 in the following points.

The ceramic heater-element 21 is provided with paired electrodes 26*a* and 26*b* on both end portions of an incomplete ring-portion 2, wherein each of the electrodes 26*a* and 26*b* is projected outwardly from the circularly shaped outer circumference of the heater portion 2, while both upper and rear faces of the electrodes are coplanar with both upper and rear faces of the heater-portion 2. Furthermore, there are provided respective through bores 28*a* and 28*b* for the electrode-portions 26*a* and 26*b*, respectively, each of which is bored towards in the same direction as that of the axis 0. The metallic electrodes of the threaded type are incorporated into the respective through bores 28*a* and 28*b*. Similar to the embodiment as described earlier, even for this embodiment, the cross-sectional dimensions of the heater portion 2, which is cross-sected along a line A—A, is much smaller then either of cross-sectional areas of the electrode-portions 26*a* and 26*b*, whcih are respectively cross-sectioned along respective lines B—B and C—C. Such being the case, all the cross-sectional areas are those directed perpendicularly with respect to the direction of the flow of electricity. Accordingly, as described earlier, the heater-portion 2 can generate the heat in quite a uniform mode, with local extraordinary heat generation being eliminated. Furthermore, the heat flux from each of the electrode portions 26*a* and 26*b* is restricted to be relatively much lower than that from the heater-portion 2. More particularly, the temperature in and around each of the electrode-portions is kept relatively much lower than that in and around the heater-portion.

The ceramic heater-element 31 shown in FIG. 9 is not substantially different from that 21 shown in FIG. 8. However, according to this embodiment, each of electrode-portions 36*a* and 36*b* is configurated as a shoulder-portion at each end portion of the heater-portion 2.

Top surface of each electrode-portion of these embodiments is treated by the silver-paste spreading or spread by the silver-paste.

Although the present invention has been fully described by way of example with reference to the accompanying drawings, it is to be noted here that various changes and modifications are apparent to those skilled in the art. Therefore, unless otherwise such changes and modifications depart from the scope of the present invention, they should be construed as included therein.

What is claimed is:

1. An integral ceramic heater-element for use in a plug type cigarette lighter situated in an inner car body, said integral ceramic heater element comprising:

an annular shaped heater portion having a radially extending gap thereby providing two opposing cross sectional end portions defined by the radial edges of said gap;

two electrode portions, each of said two electrode portions having an electrode end portion, said two electrode end portions being joined to and integral with one side of said annular shaped heater portion such that each one of said electrode end portions is respectively situated adjacent to one of said two opposing cross-sectional end portions each of said two electrode portions projects substantially longitudinally outward from said annular shaped heater portion and the longitudinal edges of said two electrode end portions are substantially longitudinally parallel to the central longitudinal axis of said annular shaped heater portion; and the diametrical cross-sectional area of said annular shaped heater portion being relatively smaller than the diametrical cross-sectional area of either one of said two electrode portions; and the planes coextensive with the peripheral edges of the diametrical cross section of said annular shaped heater portion intersecting at substantially right angles.

2. An integral ceramic heater element as claimed in claim 1, wherein the edges of said two electrode portions adjacent the outer peripheral circumferential wall of said annular shaped heater portion and the outer peripheral circumferential wall of said annular shaped heater portion are of substantially the same radial dimension with respect to the central longitudinal axis of said annular shaped heater portion.

* * * * *